United States Patent [19]

Lin et al.

[11] Patent Number: 4,884,062

[45] Date of Patent: Nov. 28, 1989

[54] ALARMING WALLET ACTUATED BY A PICKPOCKET'S FINGERS

[76] Inventors: Wen-Tsung Lin; Sheng-Chuan Chen, both of P.O. Box 30-443, Taipei, Taiwan

[21] Appl. No.: 256,312

[22] Filed: Oct. 11, 1988

[51] Int. Cl.[4] ..... G08B 13/14

[52] U.S. Cl. ..... 340/571; 340/568

[58] Field of Search ..... 340/571, 568

[56] References Cited

U.S. PATENT DOCUMENTS 3,930,249 12/1975 Steck et al. ..... 340/571

4,080,595 3/1978 Rosen ..... 340/568

*Primary Examiner*—Glen R. Swann, III

[57] ABSTRACT

An alarming wallet includes: an alarm switch having two contactors respectively formed on two leaves of the wallet whereby upon a withdrawal of the wallet from an owner's pocket, the two contactors of the alarm circuit will be closed by a pickpocket's fingers to sound the alarm for alerting a wallet owner and preventing the theft of his or her wallet.

8 Claims, 1 Drawing Sheet

ALARMING WALLET ACTUATED BY A PICKPOCKET'S FINGERS

BACKGROUND OF THE INVENTION

Steck et al. disclosed a self actuating wallet alarm in their U.S. Pat. No. 3,930,249 in which the wallet has an alarm system actuated in response to variations of electromagnetic radiation such as exposure to a light source upon a removal from an owner's pocket, which however has the following drawbacks:

1. When the wallet is withdrawn under a dark surroundings, the alarm system will not be actuated without subject to a light exposure.

2. If the photo-electric cell of the alarm system is operative within the wave-lengths in the range of body heat emitted from a person such that the alarm system would actuate upon being removed from a person. Nevertheless, if the wallet is used in a tropical area such as in African and most middle east countries having an environment temperature higher or equal to a body heat, how can the alarm system be actuated under no change of temperature or wave-lengths.

The present inventors have found these drawbacks of a conventional wallet alarm and invented the present alarm wallet actuated by a picker's fingers.

SUMMARY OF THE INVENTION

The object of the present invention is to provide an alarming wallet including an alarm switch having two contactors respectively formed on two leaves of the wallet whereby upon a withdrawal of the wallet by a pickpocket, the two contactors of an alarm circuit will be closed by a picker's fingers to sound the alarm for alerting a wallet owner and preventing the steal of the wallet.

DETAILED DESCRIPTION

Figure 1:
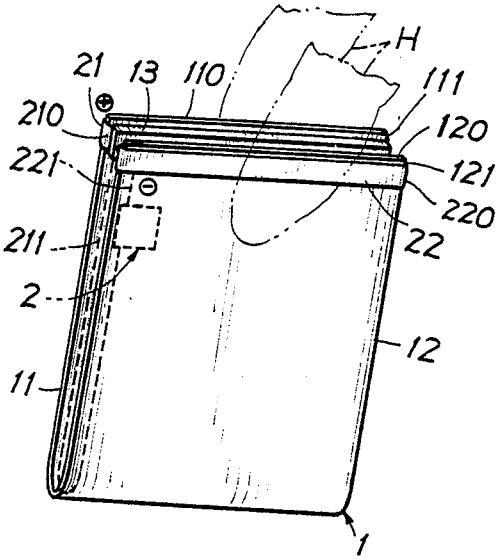
FIG. 1 is a perspective illustration of the present invention.

As shown in FIGS. 1-4, the present invention comprises: a wallet 1 having two leaves 11, 12 foldable upon each other, and an alarm circuit 2 formed in the wallet 1.

The alarm circuit 2 includes: an alarm switch 20 having two contactors 21, 22 respectively formed on the outer surfaces of the two leaves 11, 12 of the wallet 1, a transistor 23 connected between the alarm switch 20 and a sounding integrated circuit 24, the sounding integrated circuit 24 having a piezoelectric buzzer 25 connected with the integrated circuit 24, and a power source 26 such as dry cells of 3 volts.

The sounding integrated circuit 24 includes a pin of VDD connected to a positive pole of the power source 26, a pin of VSS grounded, a trigger pin TGO connected to a collector of the transistor 23. The integrated circuit 24 may be C1C 5810 produced from Electronics Research & Service Organization of ITRI, Taiwan.

The transistor 23 has its base connected to a first contactor 21 of the alarm switch 20 of the alarming circuit 2, and has its emitter connected to the positive pole of power source 26. The second contactor 22 is connected to negative pole of power source 26 or grounded.

The first contactor 21 is made as a longitudinal thin-layer conductive strip adhered on an outer surface of an upper portion 111 of a first leaf 11 of the wallet 1 proximate to an uppermost edge 110 of the first leaf 11, having two crimping edges 210 crimped on two upper side edges of the first leaf 11. An insulator spacer 13 is adhered on an inside surface of the upper portion of the first leaf 11 to separate from the second contactor 22 formed on the second leaf 12 to prevent short-circuit between the two contactors 21, 22.

The second contactor 22 is also made as a longitudinal thin-layer conductive strip adhered on an outer surface of an upper portion 121 of a second leaf 12 of the wallet 1 facing in a direction opposite to the first contactor 21, proximate to an uppermost edge 120 of the second leaf 12 of the wallet 1, having two crimping edges 220 crimped on two upper side edges of the second leaf 12.

Either contactor 21 or 22 is formed on either leaf 11 or 12 transversely across a full width of either leaf 11 or 12. Naturally, plural parallel strips of each contactor 21 or 22 may also be formed on each leaf 11 or 12, all strips on each leaf being electrically connected to the power source 26 and the integrated circuit 24 through the alarm switch 20. The first contactor 21 is connected to the transistor 23 by a first wire 211, whereas the second contactor 22 is connected to the negative pole of the power source 26 through a second wire 221. All elements of the alarming circuit 2 can be built into the wallet leather, exposing only the two contactors 21, 22 respectively formed on the outer surfaces of the two leaves 11, 12 of the wallet 1.

Figure 2:
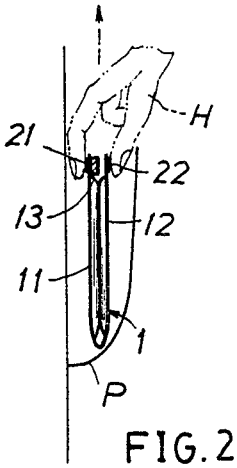
FIG. 2 is a side-view illustration showing a removal of the wallet of the present invention from an owner's pocket.
Figure 4:
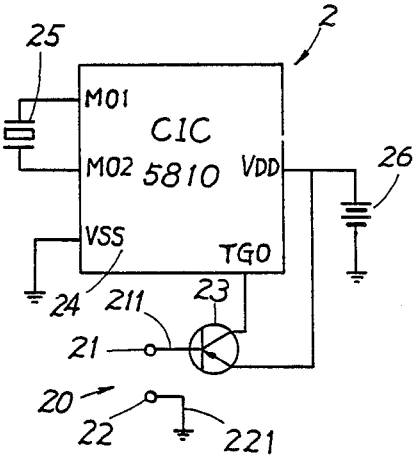
FIG. 4 is a circuit diagram of an alarming circuit of the present invention.

When a pickpocket removes the wallet 1 of the present invention from an owner's pocket P, purse or handbag as shown in FIGS. 2 and 1, the fingers of a pickpocket's hand H will clamp or hold the two leaves 11, 12 of the wallet 1 to electrically connect the two contactors 21, 22 formed on the two leaves 11, 12 to form a biasing circuit or the transistor 23, thereby saturating and rendering the transistor 23 conductive so as to trigger the integrated circuit 24 through the TGO pin as shown in FIG. 4 and to cause the alarm sounding through the piezoelectric buzzer 25 connected with the integrated circuit 24, therefore alerting the wallet owner and preventing the wallet from being stolen.

Figure 3:
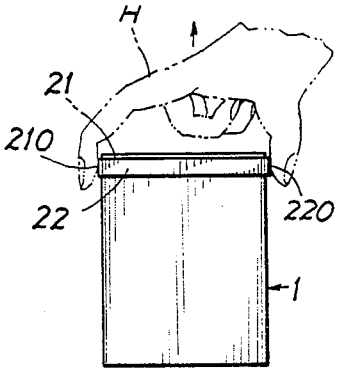
FIG. 3 shows another way of withdrawal of the wallet of the present invention.

If a pickpocket's hand clamps the two sides of the wallet 1 stored in a pocket of the wallet owner as shown in FIG. 3, the pickpocket's fingers touching the two crimping edges 210, 220 of the two contactors 21, 22 will still close the alarm circuit 2 to cause its sounding and alerting effect.

Figure 5:
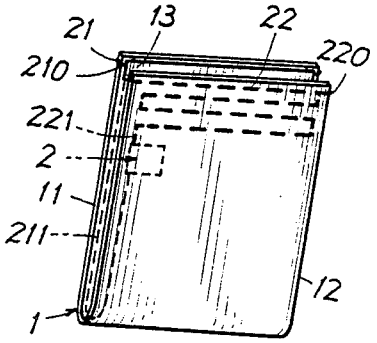
FIG. 5 shows another preferred embodiment of the present invention.

The contactor 21 or 22 can be made of electrically conductive metal such as aluminum sheet or foil having a thin thickness or any other electrically conductive materials. As shown in FIG. 5, the contactor 21 or 22 may be formed as a stitching thread made of electrically conductive materials sewn on the upper portion 111 or 121 of either leaf 11 or 12 of the wallet 1. Since human body is electrically conductive, the contactors 21, 22 may be made of any electrically conductive materials mounted, coated, plated, sewn or adhered on the outer surfaces of the wallet leaves 11, 12.

Even the wallet owner himself or herself may still actuate the alarm sounding when removing his or her own wallet, a pushbutton (not shown ) for switching off the alarm circuit can be built or concealed in a suitable location on the wallet to prevent a self disturbance by the alarm sounding. However, such a switching off button is not critical in this invention and can be modified by those skill in the art.

The present invention has the following advantages superior to a conventional wallet alarm:

1. Regardless of light intensity of the environment, the wallet of the present invention once being removed by a picker's hand will make the alarm sounding for better security purpose.

2. The electronic circuit is so simple that its production cost can be very low.

3. Regardless of weather and surrounding temperature, the present invention can be successfully actuated by human contacting, rather than the exposure of variation of wave-lengths in terms of temperature differences between a body heat and a surrounding temperature.

We claim:

1. An alarming wallet comprising:

a wallet having two leaves foldable upon each other; and an alarming circuit including: an alarm switch having two contactors respectively formed on two outer surfaces of the two leaves of the wallet, a transistor connected to and actuated by said alarm switch, a sounding integrated circuit connected with a piezoelectric buzzer and connected to a power source through said transistor, whereby upon a withdrawal of said wallet from an owner's pocket, purse or handbag by a pickpocket, the pickpocket's fingers will touch said two contactors of said alarm switch to render said transistor conductive to trigger said sounding integrated circuit and said piezoelectric buzzer for alerting a possible theft of said wallet.

2. An alarming wallet according to claim 1, wherein each said contactor of said alarm switch is made of a longitudinal electrical conductive strip transversely formed on an upper portion of one of said two leaves of said wallet.

3. An alarming wallet according to claim 2, wherein each said longitudinal electrical conductive strip is a thin-layer strip transversely formed across a full width of a leaf of said wallet.

4. An alarming wallet according to claim 2, wherein each said longitudinal electrical conductive strip has two side crimping edges respectively crimped on two side edges of the associated leaf of said wallet.

5. An alarming wallet according to claim 1, wherein said two contactors of said alarm switch are respectively formed on two outer surfaces of said two leaves of said wallet, one said contactor facing in a direction opposite the other contactor.

6. An alarming wallet according to claim 1, wherein any one of said leaf of said wallet is fixed with an insulating spacer on its inside surface so as to be electrically separated from the other wallet leaf.

7. An alarming wallet according to claim 1, wherein each said contactor formed on each said leaf has a wire electrically connected to the remainder of said alarm circuit.

8. An alarming wallet according to claim 1, wherein each said contactor is an electrical conductive stitching thread sewn on said wallet leaf.

* * * * *